US005694413A

United States Patent [19]

Durr et al.

[11] Patent Number: 5,694,413

[45] Date of Patent: Dec. 2, 1997

[54] PROCEDURE AND APPARATUS FOR CONTINUOUS SUPPLY OF HEAT IN ELECTRICALLY CONDUCTIVE BULK GOODS

[75] Inventors: Herbert Durr, Buchen; Paul Eirich, Hardheim, both of Germany

[73] Assignee: Maschinenfabrik Gustav Eirich, Germany

[21] Appl. No.: 676,102

[22] Filed: Jun. 2, 1996

Related U.S. Application Data

[63] Continuation of Ser. No. 194,929, Feb. 14, 1994, abandoned.

[30] Foreign Application Priority Data

Feb. 12, 1993 [DE] Germany ..... 43 04 217.1

[51] Int. Cl.[6] ..... F27D 3/00

[52] U.S. Cl. ..... 373/79; 373/65; 373/82; 373/108; 373/115; 219/388; 75/10.41

[58] Field of Search ..... 373/60, 62, 63, 373/65, 66, 72, 79, 81, 82, 102, 108, 111, 115, 126, 48; 219/383, 388; 75/10.41, 10.43, 10.53, 10.59; 204/225, 245; 34/165; 432/75; 110/237

[56] References Cited

U.S. PATENT DOCUMENTS

| | | | |
|---|---|---|---|
| 757,634 | 4/1904 | Price | 373/114 |
| 779,844 | 1/1905 | Galbraith | 373/120 |
| 815,016 | 3/1906 | Heroult | 75/10.41 |
| 1,430,971 | 10/1922 | Fornander | 373/113 |
| 4,192,962 | 3/1980 | Nakao et al. | 373/120 |
| 4,261,857 | 4/1981 | Nakao | 373/120 |
| 4,405,433 | 9/1983 | Payne | 204/225 |
| 4,624,003 | 11/1986 | Eirich et al. | 373/120 |
| 4,655,968 | 4/1987 | Quieser et al. | 110/237 |
| 4,807,246 | 2/1989 | Moss | 373/120 |
| 5,317,592 | 5/1994 | Van Staden | 373/109 |

FOREIGN PATENT DOCUMENTS

| | | |
|---|---|---|
| 092036 | 10/1983 | European Pat. Off. . |
| 2384412 | 10/1978 | France . |
| 2410235 | 6/1979 | France . |
| 537229 | 10/1931 | Germany . |
| 1133513 | 7/1962 | Germany . |
| 1571443 | 6/1975 | Germany . |
| 2311467 | 8/1975 | Germany . |
| 2954379 | 12/1987 | Germany . |
| 3611687 | 11/1989 | Germany . |
| 2063030 | 5/1981 | United Kingdom . |
| 8002740 | 12/1980 | WIPO . |

*Primary Examiner*—Tu B. Hoang

*Attorney, Agent, or Firm*—Killworth, Gottman, Hagan & Schaeff,LLP

[57] ABSTRACT

The invention relates to a procedure for continuous supply of heat into electrically conductive bulk goods by exploiting the electrical resistance thereof in an oven chamber with an inlet opening and a drawing-off apparatus for continuous throughput of bulk goods, wherein during the throughput of material, electrical energy in the material is conducted, and to an apparatus for continuous supply of heat into electrically conductive bulk goods by exploitation of the electrical resistance thereof, in an oven chamber (1) with an inlet opening (15) and a continuous drawing-off apparatus (9) for the bulk goods, and with at least one pair of electrodes (14, 16, 19) arranged one above the other, via which the electrical energy in the material is conducted during the continuous throughput of material. Provision of an apparatus in which heat can continuously be supplied in an efficient manner to electrically conductive bulk goods by exploitation of the electrical resistance thereof during continuous throughput of material is proposed according to the invention in that having regard to the procedure, the material is conducted substantially parallel to the direction of current, between the positive and negative electrodes, and that the drawing-off apparatus is used at least as a part of the negative electrode or the neutral conductor and that having regard to the apparatus, the positive pole electrode or phase electrode (14) is located in the region of the input opening, and the negative pole electrode or neutral conductor electrode (16, 9) is provided in the region of the drawing-off apparatus (9) and the negative pole electrode or neutral conductor electrode (16, 9) and the drawing-off apparatus are earthed.

30 Claims, 6 Drawing Sheets

PROCEDURE AND APPARATUS FOR CONTINUOUS SUPPLY OF HEAT IN ELECTRICALLY CONDUCTIVE BULK GOODS

This application is a continuation of U.S. patent application Ser. No. 08/194,929, filed on Feb. 14, 1994, now abandoned.

BACKGROUND OF THE INVENTION

The invention relates to a procedure for continuous supply of heat into electrically conductive bulk goods by exploiting the electrical resistance thereof in an oven chamber with an inlet opening and a drawing-off apparatus for continuous throughput of bulk goods, wherein during the throughput of material, electrical energy in the material is conducted, and to an apparatus for continuous supply of heat into electrically conductive bulk goods by exploitation of the electrical resistance thereof, in an oven chamber with an inlet opening and a preferably continuously operating apparatus for drawing-off of the bulk goods, wherein the electrical energy is conducted via at least one pair of electrodes arranged one above the other.

A device for direct heating of electrically conductive bulk goods by exploitation of the electrical thermal resistance thereof is described in EP 0.092.036 B1, wherein the electrical energy is introduced via a plurality of pairs of electrodes which are galvanically separated from one another. This device mainly operates in a batch operation, that is to say, it is at zero-currant during the filling and emptying procedure. In this patent document a continuous method of operation of the heating device is also described, however problems may arise with this because electrical insulation can then no longer be ensured.

The object of the invention is to provide an apparatus in which heat can continuously be supplied in an efficient manner to electrically conductive bulk goods by exploitation of the electrical resistance thereof during continuous throughput of material, while retaining a narrow dwell time range.

SUMMARY OF THE INVENTION

This object is met with regard to the procedure described in the introduction in that the material is conducted substantially parallel to the direction of current, between the positive and negative electrodes, and that the drawing-off apparatus or discharge device is used at least as a part of the negative electrode or the neutral conductor.

With respect to the aforementioned apparatus the object is met in that the positive pole electrode is located in the region of the input opening, whereas the negative pole electrode and the drawing-off apparatus are connected to earth, and the earthing forms the negative pole.

Surprisingly, it has come to light that the drawing-off device itself can be used, for example together with its earthed housing, as a discharging electrode. This fact offers the great advantage that the total longitudinal extent of the heating device can be used for heating the electrically conductive bulk goods. In this way, the material flowing through the apparatus is supplied with electrical energy and thereby with heat during practically the whole of the throughput, and the material does not cool down noticeably until expulsion or discharge out of the apparatus. The effective dwell time available for the heating is greater for the previously described throughput time, and thereby the material throughput can be correspondingly increased without enlargement of the oven.

As the apparatus can selectively be operated with direct current or alternating current, clearly, when alternating current is used, the role of the negative electrode is taken over by the so-called neutral conductor which is at earth potential, whereas the electrode corresponding to the positive electrode is then generally denoted as a phase. The transfer from direct to alternating current is achieved by substituting the designation of the positive electrode by that of phase electrode and the designation of negative electrode by that of neutral conductor electrode. In the following, the simpler description, chiefly describing the case of direct current, will be used without, however, any intended limitation, and for purposes of the present invention, the term "negative electrode" may encompass a neutral conductor, and the term "positive electrode" may encompass a phase electrode.

In a known manner, the electrical power supplied is calculated according the formula $P=R\times I^2$. In this, R represents the resistance of the electrical bulk goods measured in Ohms and I represents the current which flows through the electrical bulk goods. The resistance R is dependent upon the electrical properties of the material, and moreover upon the cross-section of the input electrically conductive material, as well as the length thereof. The greater the length of the conductor, the greater the electrical resistance. As a result of this, the distance between the current conducting electrode and the current discharging electrode plays an important role. It means that by using the drawing-off apparatus as the current discharging electrode, the total length of the bulk goods, which has to be regarded as an electrical conductor, can be used.

This has, moreover, a large role in the start-up procedure, as it ensures that the material still located in the drawing-off apparatus is subjected to the current throughput. It is thus ensured that the discharge of cold, unheated parts of the bulk goods is avoided even at the commencement of a heating procedure.

To protect the discharge apparatus against electrical erosion, negative pole electrodes are connected in the region of the drawing-off device, so that a suitable partial amount of the current can be dissipated via these.

Because of possible wear and tear to the negative electrode by electrochemical erosion, it is moreover convenient to manufacture the parts of the drawing-off apparatus which operate as electrodes as easily replaceable parts, for example easily replaceable housing walls or the like. The whole of the drawing-off apparatus can, in the preferred embodiment, also be easily installed as a unit on the rest of the oven, and removed therefrom.

According to the electrical resistance determined by the material, or the change in resistance thereof as a result of heating, it is convenient for the introduction of the necessary specific thermal energy if the distance between the positive and negative electrodes, and thereby the total resistance of the bulk goods input can be adapted to the prevailing mechanical properties of the material (for example, the filter line) or the electrical characteristics of the material (for example, conductivity, specific resistance etc.). Thus, according to the invention it is provided that the change in the distance between positive and negative electrodes is done by stepped connection and disconnection of individual negative electrodes, located one above the other. For certain changes in the operating conditions on the other hand, it appears appropriate if instead of stepped connection or disconnection, one of the electrodes, preferably a negative electrode, is steplessly displaceable in the direction of the current.

During the continuous downward movement of the bulk goods in the shaft-shaped oven chamber, there is always local deposition of the particles. This means that no preferred current paths form; this result is clearly indicated by a uniform temperature distribution in the bulk goods discharged.

Particularly in continuously operating heating devices of the type described above, operating, reliability plays a decisive role. These continuous installations are constantly live, and it must be reliably ensured that no danger may arise for people or for the device. By insulating the parts connected to the positive electrodes, and by earthing all parts of the device accessible from the exterior which could possibly conduct current, and by using the earth or mass for discharging current, no electrical potential is available, contact with which could endanger people.

As already emphasised, the maintenance of a pre-set dwell time plays a decisive role in heating evenly. It also means, however, that the positive electrode adjacent to the inlet opening must constantly be covered with bulk goods. If, however, there is a breakdown in the feed quantity control, the bulk goods input can increase more and more within the oven chamber and finally fill the whole of the upper chamber and block up as far as the delivery device. In this case, a large quantity of electrical energy would flow from the positive electrode to earth in the direction of the input metering. This might result, at that point, in overheating, burning or the destruction of the installation.

To prevent this, in a variation of the invention a so-called guard electrode, which is electrically connected to earth (mass), is provided In the space containing no bulk goods, above the normal level of the bulk goods. If the level of bulk goods rises in an undesirable manner, the bulk goods come into contact with the guard electrode. In this case, a current flows to earth via the guard electrode and can be sensed, measured and suitably processed as a signal to bring the installation to a safe operating condition. Instead of measuring the amount of current flowing, the measurement of the voltage now present between the guard electrode and earth could be used for processing a signal.

If on the other hand as a result of a breakdown in the feed quantity control there is a decrease in the bulk goods level, and if the bulk goods level were to sink so far that the upper positive electrode which is normally covered were to be exposed, the formation of a destructive arc between the exposed positive electrode and the bulk goods level would be almost impossible to prevent. This would again mean the installation was endangered. To eliminate this danger, it is proposed in a further embodiment of the invention to connect a further control electrode, which under normal operating conditions must always be covered with bulk goods, directly above the upper, positive electrode. This guard electrode is connected to the earth wire via a suitably high resistance, so that the current discharged thereby under normal operation stays restricted to a minimum. In the absence of the voltage or in the absence of the measured current a signal is again available for bringing the installation into a safe operating condition. It makes sense to then attempt to correct the gravimetric feed quantity control sufficiently to achieve reliable covering of the upper electrode.

Correspondingly, this is also true of the over-fill signalling, which must first stop only further material input or restrict it more greatly, or otherwise must accelerate the drawing-off or discharge of material. Only in a borderline case (for example, when a second guard electrode is reached or when the partial current flowing via the guard electrode further increases beyond a pre-settable limit value) is the entire heating device switched off.

The guard electrode in the bulk goods free space is sensibly formed as a preferably circular, ring-shaped electrode which offers free space for the falling though or trickling through of the bulk goods coming from the direction of the supply device.

The constructional configuration of the drawing-off apparatus also plays an important role. This also includes the choice of material, as in this case, materials with suitable electrical conductivity and thermal stability have to be selected. While with very fine, powdery bulk goods the use of one or more discharge screws has proved particularly worthwhile, so-called drag-chain conveyors are more suitable for coarse grained material as in this case mechanical breaking of the coarse bulk goods particles, which could occur in between the screw and the housing is largely avoided. Container bases with slate which are adjustable along their longitudinal axis to alter the width of the gaps have been shown to be particularly suitable for medium grained material.

For optimum functioning of the heating apparatus, regular throughput of material and an extremely narrow dwell time range play an important role. A narrow dwell time range (little variation in dwell time) is achieved when the discharge is formed so that a core flow or a one-sided bulk goods material flow is reliably avoided. This also includes suitable constructional formation of the electrodes, wherein on the one hand the electrically conductive material must discharge to the surface of the electrodes with sufficient pressure to ensure transfer of current, and on the other hand the free throughput of the material is not impeded. According to the invention, it is proposed that the positive electrode located at the material entrance be formed as a rectangular ring, in the shape of a downwardly (or inwardly) open truncated pyramid. Because of the inclination of the surfaces of this rectangular ring, there is the desired, necessary structured pressurisation of the material onto the electrode, but on the other hand the free through flow is not impeded where there is a sufficiently large ring cross-section. To enlarge the current transferring surface, current conducting wires or plates are connected parallel to one another and in the direction of the flow, in the interior of the rectangular ring in a grid pattern.

With electrically conductive bulk goods which tend to form gas during heating or simply because of the current through flow, embodiments of the invention have proved useful which provide for the formation of hollow spaces inside the shaft which are connected to the material which is current-carrying and is heating up. In an embodiment of the invention this is achieved in that the cross-section of the shaft is widened in a stepwise manner according to the direction of flow of the material and at the same time diagonally with respect to the direction of flow of the material. When the material flows down from above, an upper section of the shaft should have a smaller cross-section than a lower cross-section, and the transition should be in a stepwise manner, abruptly or even with an undercut (with respect to the direction of the flow) in such a way that below the transitional step, a hollow space is formed simply because of the conical shape of the bulk goods which is created at the transition by the bulk goods flowing down from above. This hollow space then serves as a collecting area for gas which forms during heating and/or current flow, wherein at one or more places in the wall, or rather in the step-shaped transition in the shaft wall, an exhaust opening is provided, which preferably can be locked, and from which the gas can be drawn off or sucked off.

In another variation, interior components are provided, which extend diagonally across the interior of the shaft, and which are so formed that, again, because of the bulk goods flowing or sinking below from above, hollow spaces am created below these interior components, which serve as gas collection areas. Conveniently, such interior components are convex, viewed from the direction facing the flow of the material, and concave in the opposite direction, so that gas can collect in the concave recess and escape or flow unhindered in the diagonal direction along the interior components. The exact cross-sectional shape of the interior components is thus of secondary importance, and they could be semi-circular, V-shaped, or if of sufficient width, even flat plates, as long as hollow spaces form underneath them because of the bulk goods sinking down below from above, along which the gas formed can flow substantially unhindered in the direction of the exhaust openings which are preferably provided in the wall of the container.

The invention will now be described and explained in more detail with the aid of the following drawings:

BRIEF DESCRIPTION OF THE DRAWINGS

In FIG. 1, the cross-section of a heating device according to the invention can be seen, together with the location thereof beneath a supply device 11, whereas subsequently connected installations for the further processing of the heated material are not shown here. As a result of this, the representation ends with discharge from the drawing-off apparatus or discharge device 9. The supply device 11 is shown here as a screw conveyor with a conveying screw 6, which is connected to the entry opening 25 of the oven 1 by means of an elastic connecting element 7 which can also be electrically insulating or fixed to the upper end of the oven in an electrically insulated manner.

Figure 1:
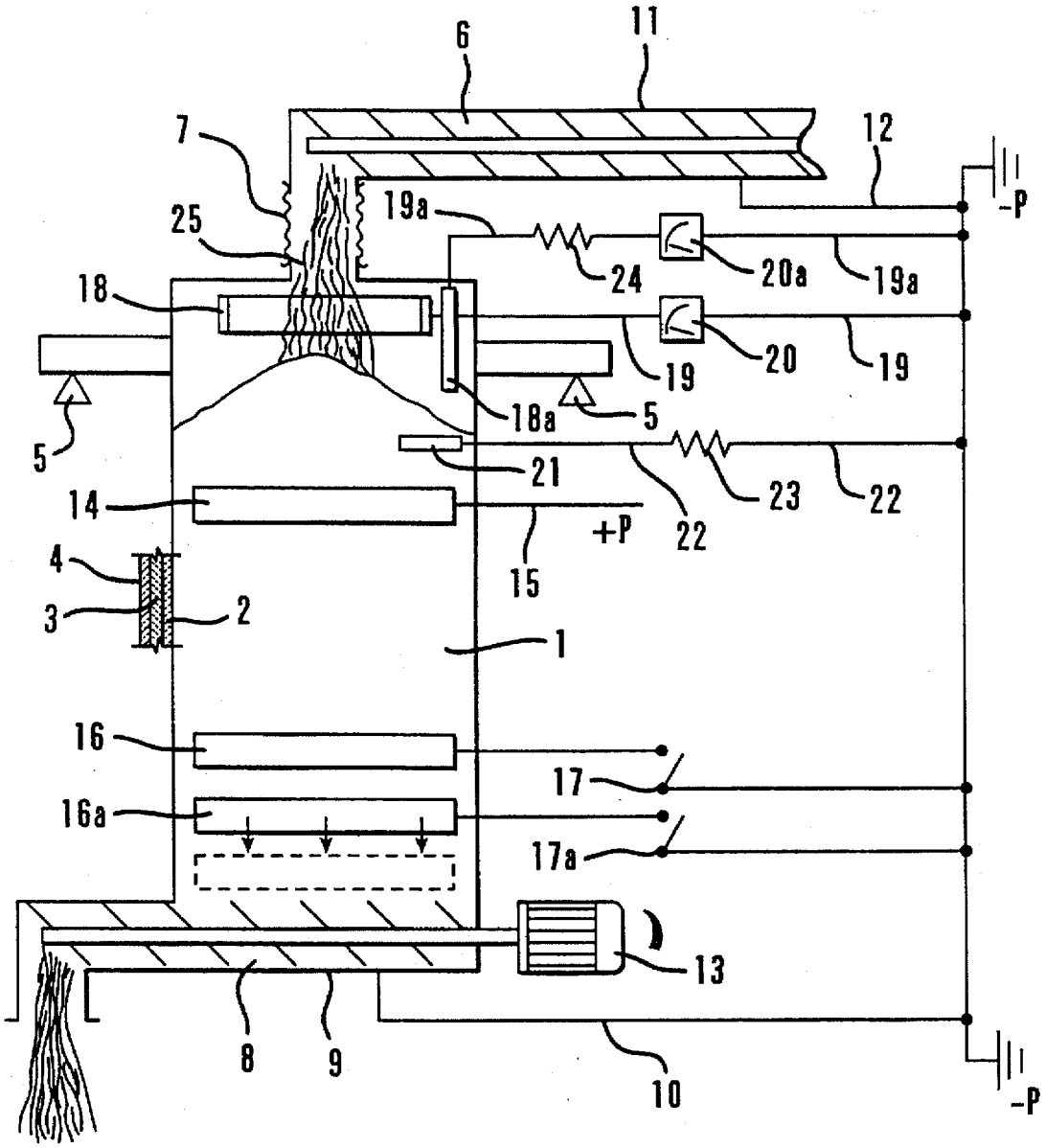
FIG. 1 shows a longitudinal section through the heating device according to the invention.

The oven chamber 1 is formed as an upright shaft with a rectangular, approximately square cross-section, wherein the height is significantly greater, preferably approximately two to five times greater, than the base of the cross-section. The interior of the oven is lined on all sides with a heat resistant ceramic material. The cross-section of the walls, and the ceramic plates 2, are only schematically indicated in one place. The ceramic walling follows heat insulation 3, which is also only shown schematically, as well as electrical insulation 4. The whole oven chamber is located in a steel housing, which is not shown in more detail here, and which is mounted on pressure gauges 5 for sensing the weight of the heating device, inclusive of its contents. The bulk goods to be heated which are electrically conductive and are also mixtures of electrically conductive and non electrically conductive bulk goods, are metered through the conveyor screw 6 in a constant mass stream. The constant mass stream is important for the maintenance of a pre-set dwell time for the bulk goods to be heated in the oven chamber. The supply device and the heating device are connected together by an elastic coupling 7 for load engineering reasons.

The lower end of the shaft-shaped oven chamber forms the discharge device 9 and a conveyor screw 8. The discharge device is provided as a replaceable part which may be dismantled from the oven chamber. The housing of the drawing-off apparatus 9 is electrically connected to earth via a suitable cable connection 10. The same is true of the housing of the supply device 11, which is connected to earth via the cable 12.

According to the pre-set throughput quantity, that is to say according to the mass stream arriving, the discharge capability of the drawing-off apparatus 9 is regulated by an adjustable drive 13 so that the weight, which is measured with fie pressure gauges 5, remains constant. In this way a constant degree of fullness, or constant filling level of bulk goods in the oven chamber is ensured. From the volume of the filling and from the throughput of mass, or the volume of throughput of bulk goods, the dwell time can be determined. The maintenance of a constant dwell time together with the measures described above is the necessary prerequisite for a constant discharge temperature of the bulk goods.

The heating device can be operated with direct current as well as with alternating current. Supply of the heating current is by the positive pole electrode or phase 14 in the upper region of the oven. It is connected by means of a suitable connection cable 15 to the electrical supply. The discharge of the current is by way of the housing of the drawing-off apparatus 9 via the connecting cable 10 to earth or via one of the electrodes 16 and **16*a* shown here. Both electrodes are connected to the earth cable via suitable switching equipment 17 and 17*a*** and thus can selectively be switched on or off.

In the space free of bulk goods above the bulk goods level, a so-called guard electrode 18 is located, which is connected to the earth cable via an electrical cable 19. A current or voltage measurement device 20 is connected in the earth cable. If there is an increase in the bulk goods level inside the oven chamber, the space free of bulk goods fills with electrically conductive material until the guard electrode 18 is touched. In this case, a voltage is applied between the guard electrode and the earth and a current can flow. By using a suitable signal, which is not shown here, measures can be undertaken to bring the installation to a safe operating condition. The guard electrode 18 can either be shaped as a ring electrode, as shown here, or as a bar electrode **18*a* which extends from the oven chamber cover downwards into the space free of bulk goods. Cables 19*a* and signal sensor 20*a*** are suitable in this case.

The control electrode 21 is always covered with bulk goods, as a result of which current constantly flows via the cables 22 through a resistance (R1) 23 to earth. Voltage or current are constantly controlled in a manner not shown in more detail here. When the current and/or voltage decreases at the resistance 23, the installation again has to be returned to a safe operating condition, as a drop in the bulk goods level below the current discharging electrode 14, could, particularly in the case of direct current, cause formation of arcs.

Figure 2:
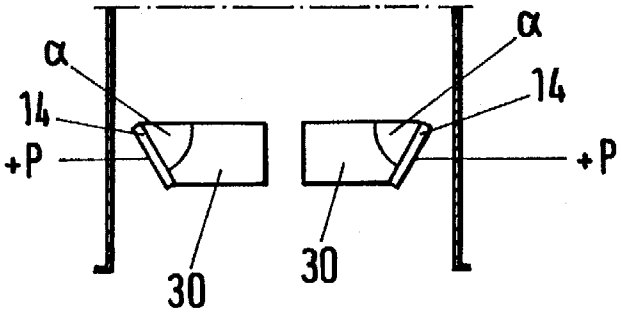
FIG. 2 shows a cross-section through the current supplying upper electrode.
Figure 3:
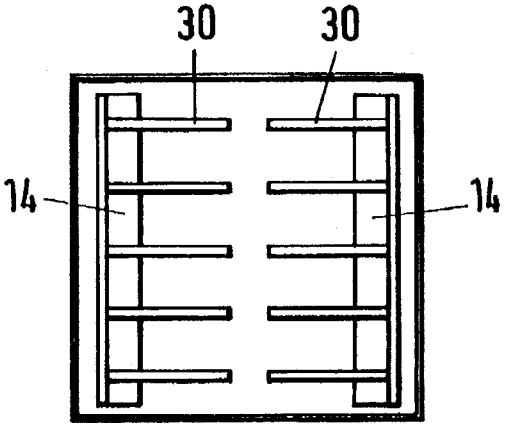
FIG. 3 shows a top view of the current supplying upper electrode.

In FIGS. 2 and 3 details of the current conducting upper electrode 14 are shown. In this case, the electrode is bisected for easier assembly. The electrode 14 is composed of two electrically conductive plates which are located one above the other and are inclined at an angle G with respect to the horizontal. From these inclined electrode plates 14 there again extend, arranged in a grid pattern, tongues 30, which are also plate shapes and are parallel to each other and set vertically, that is to say in the direction of flow of the material, on the one hand not to unnecessarily impede the flow of material, and on the other hand to provide a large surface for electrical contact with the electrically conductive bulk goods. These grid-like plates 30 also serve to provide a comparative reduction in the material flow and can, to this end, be formed longer and so placed that they broadly clasp a piece of an electrode plate 14 in opposite spaces on the grid plate 30. In another design, it would also be conceivable that the electrode 14 is formed as a ring electrode in the form of a cover of a truncated pyramid or in the shape of a funnel and, instead of the grid plate 30, plates which are for example extend crosswise between the opposite sides or diagonally through the funnel are provided, which on the one hand provide a large current transfer surface in the material, and on the other hand also contribute to a comparative reduction of the material flow, so that, for example the material does not flow down faster in the centre of the shaft than in the outside areas, or vice versa. The comparative reduction in the material flow is mainly determined by the way in which the material is discharged at the bottom end of the shaft, which has to discharge the material from the whole of the cross-section of the shaft as evenly as possible.

Figure 4:
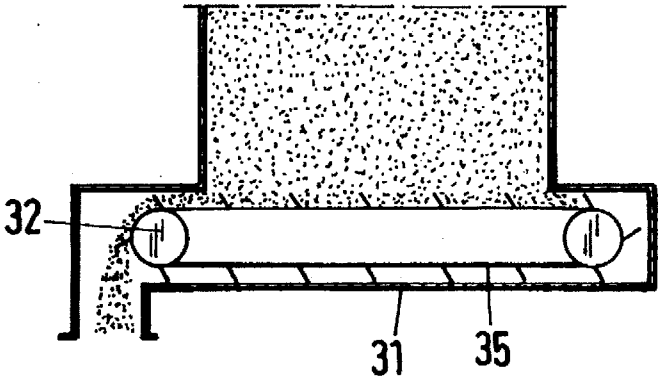
FIG. 4 shows a drawing-off apparatus with a drag-chain conveyor.

As an alternative to the drawing-off device shown in FIG. 1, in the form of screw bottom, an embodiment with a drag-chain conveyor is shown in FIG. 4. The housing 31 of this drag-chain conveyor is connected to earth. The drag-chain conveyor can normally be formed as a chain band which extends across the whole width of the oven shaft. The chain band 35 is provided with a steplessly adjustable drive 32, which is not shown here, to guarantee a constant dwell time according to the mass flow delivered.

Figure 5:
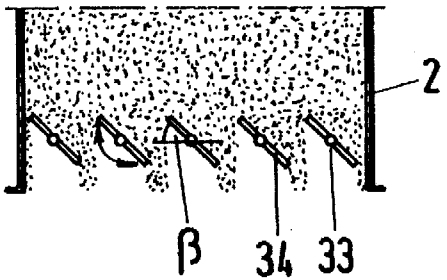
FIG. 5 shows an adjustable slatted base.

As a further alternative according to the invention, a slatted base is shown in FIG. 5. The slatted base directly forms the bottom end of the shaft-shaped oven shaft. The angle of the individual slats 34 can be individually or jointly adjusted about their axes 33. According to the opening width of the angle β, more or less heated bulk goods flow through the open cross-section between the slats. Also in this case, the actual discharge member, namely the individual slats, are connected to earth, and thus form the negative pole or neutral conductor of the electric circuit. In FIG. 5, representation of a complete angular adjustment device for the slats has been dispensed with.

Figure 6:
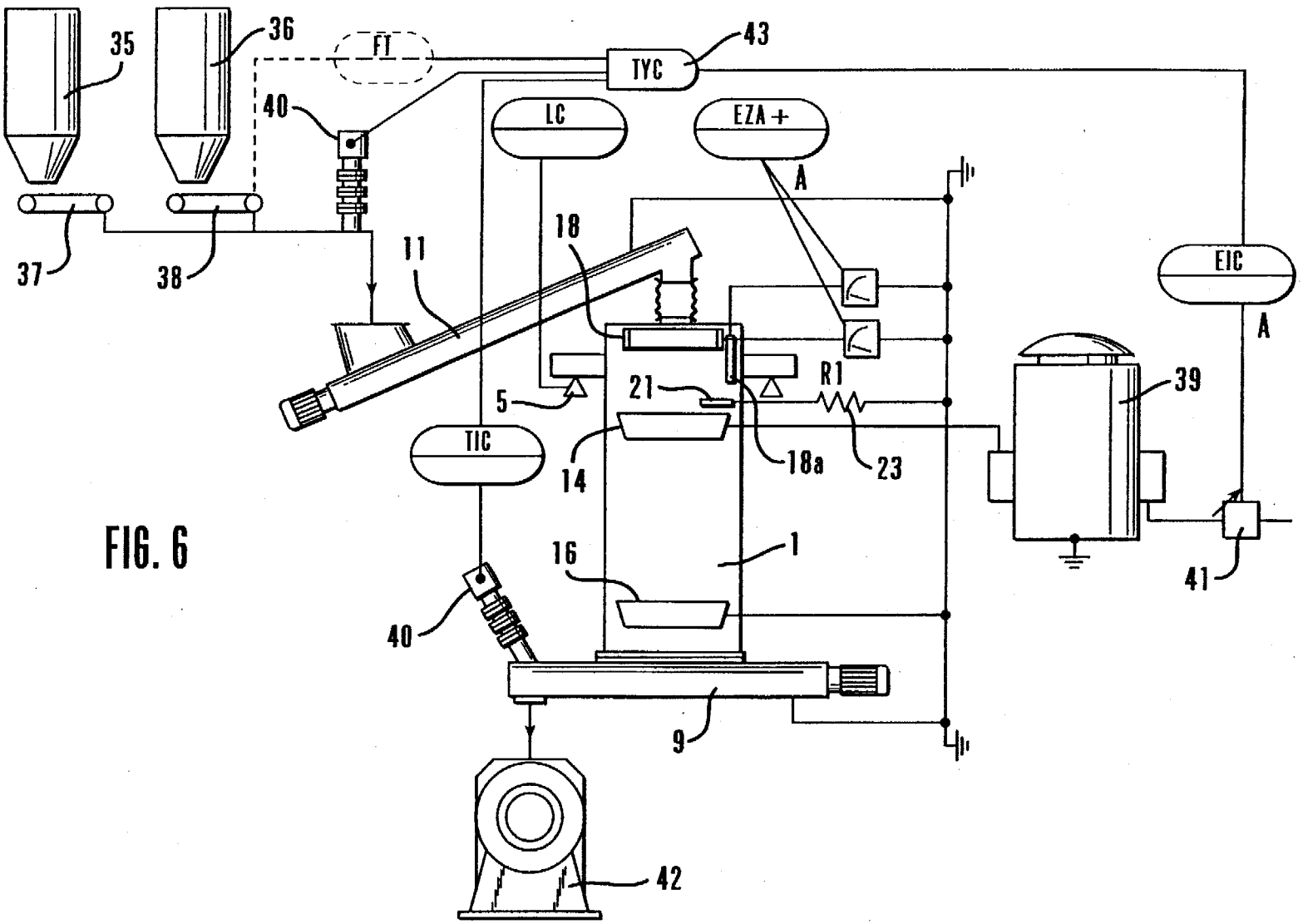
FIG. 6 is a schematic representation of an installation with a heating device according to the invention.

FIG. 6 shows the arrangement of the heating device in a complete installation. In the silos 35 and 36, the bulk goods to be heated are stored, and these can be coke, graphite, coal and also mixtures of electrically conductive and non electrically conductive bulk goods. Conveyor belt balances, which sense the mass flow gravimetrically are designated 37 and 38. The bulk goods removed from the silos 35 and 36 arrive in the oven chamber 1 via the metering device 11 and leave the heating system as heated bulk goods with the aid of the drawing-off apparatus 9. They subsequently arrive in a processing machine 42 in which further components such as binding media or the like can be added. The temperature measuring device 40, for example a radiation pyrometer serves to monitor the temperature to inform the control 43 of temperature deviation which may occur along the way. If on the way to processing in the processing machine 42, the mass has lost temperature, a correspondingly higher energy supply is released into the bulk goods, for example by increasing the current, possibly also by increasing the dwell time. The control transformer 39 which is combined with a rectifier when the heating is by direct current, assures the necessary energy supply, in connection with an electrical site 41 for the necessary energy supply dependent upon the measured throughput capability of the conveyor belt balances 37 and 38 wherein the temperature upon delivery, measured with the temperature measuring device 43 and at discharge, measured by the temperature measuring device 40 is taken into account for calculating the performance entry.

Figure 7:
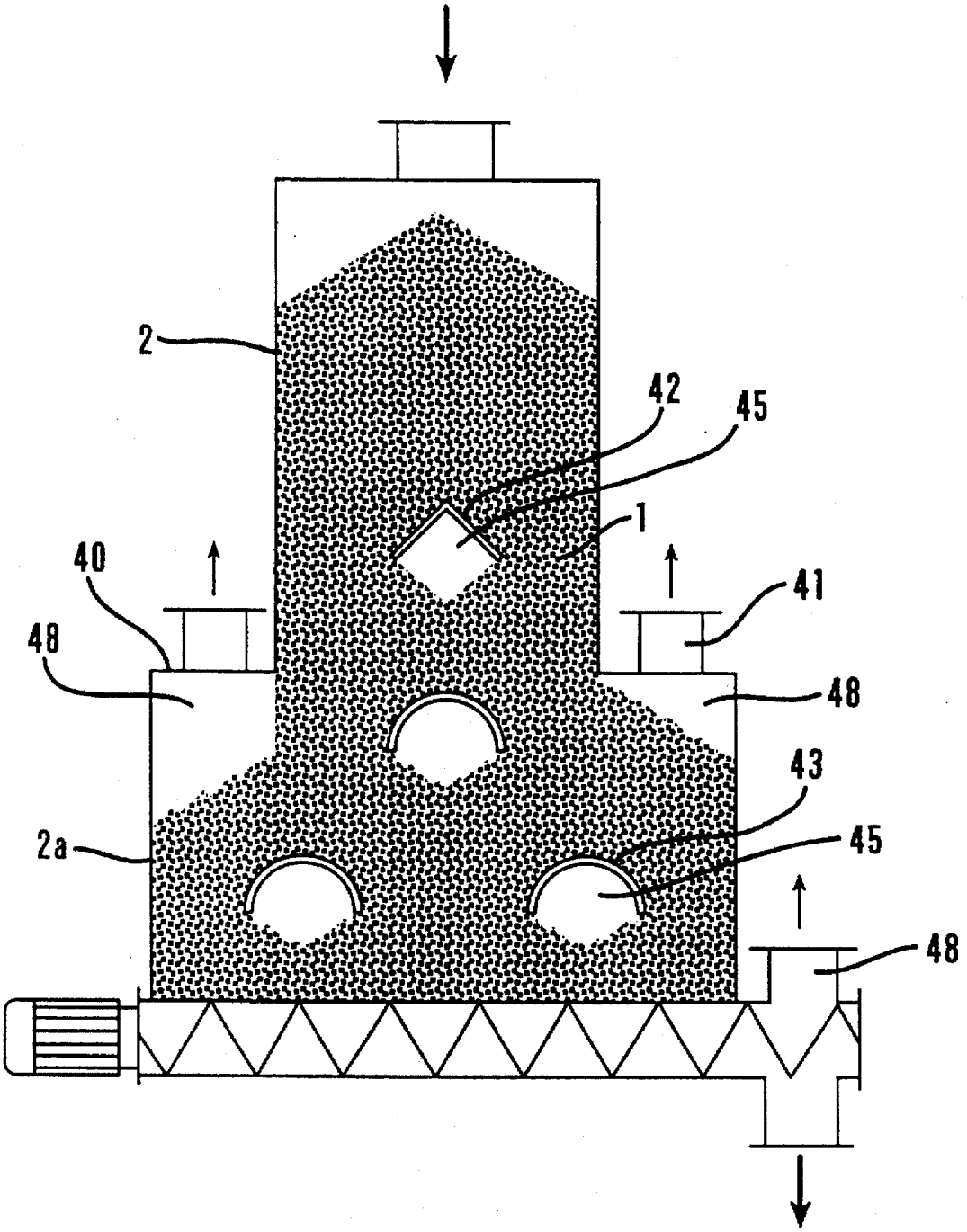
FIG. 7 is a variation of a shaft with a lower container section which is widened in a stepwise manner, and with interior components which can be seen in cross-section.

FIG. 7 shows a variation of the invention in which the lower section of the shaft is widened in a stepwise manner. Electrodes are not shown in this drawing, but can be provided in a similar arrangement and structure as has already been described with reference to FIG. 1. The material flows down from above and forms a hollow space 48 at the step-shaped transition 40, at which the container, viewed from the direction of the bulk goods, suddenly widens by a horizontal step. As the bulk good is composed of individual, grain-like elements and does not behave in the same way as a liquid, as a result of the pressure of material slipping out of the narrowed section of the container a certain cone forms in the material, even though this is possibly smaller than with free pouring material. Because of this the hollow space 48 occurs and on the stepwise transition 40, one or more lockable ventilation openings 41 are provided, through which the gas collecting in the hollow space 48 can escape or be aspirated. When the bulk cone of material is very flat, for example in the case of a very fine-grained material, and under the pressure of the high column of material in the taller configured shaft part, so that the space 48 could only perform its function as a collection and drawing off space for the forming gas in an insufficient manner, the wall of the internal container can also be lengthened downwards, from above the stepwise transition 40 towards the widened container section, as shown in the left half of FIG. 7. In this way, the formation of a sufficiently large gas collection space is ensured.

FIG. 7 also shows a cross-section of interior components 42, 43 which also define gas collection spaces and which if required are provided in addition to the stepwise widening 40, and on the other hand can replace a stepwise transition of this type, with respect to the function as gas collection space, in shafts with a substantially constant cross-section. The interior components 42, 43 are, for example, profile parts with a constant cross-section, which preferably extend diagonally and vertically to the flow of material through the container or shaft 1, and at the same time are mounted on or fastened to opposite walls 2 of the shaft. The interior components 42, 43 are convex on one side and concave on the other and arranged in the shaft so that they present their convex side to the bulk goods sinking down from above. In this connection, the terms "convex" and "concave" not only refer to cross-sections with regular, or uniformly developing curvature, but also includes, for example, the triangular or V-shaped form of the element 42, a rectangular U-shape, etc. With respect to the underside, the interior components 42, 43 do not necessarily have to be concavely shaped, as because of the appearance of the cone in the bulk goods at the lower rim of the interior components 42, 43, a hollow space 48 will in any case form even with respect to a horizontal underside. The upper convex side should however be formed if possible so that no bulk goods collect on it, but the material is simply diverted around the interior component.

Figure 8:
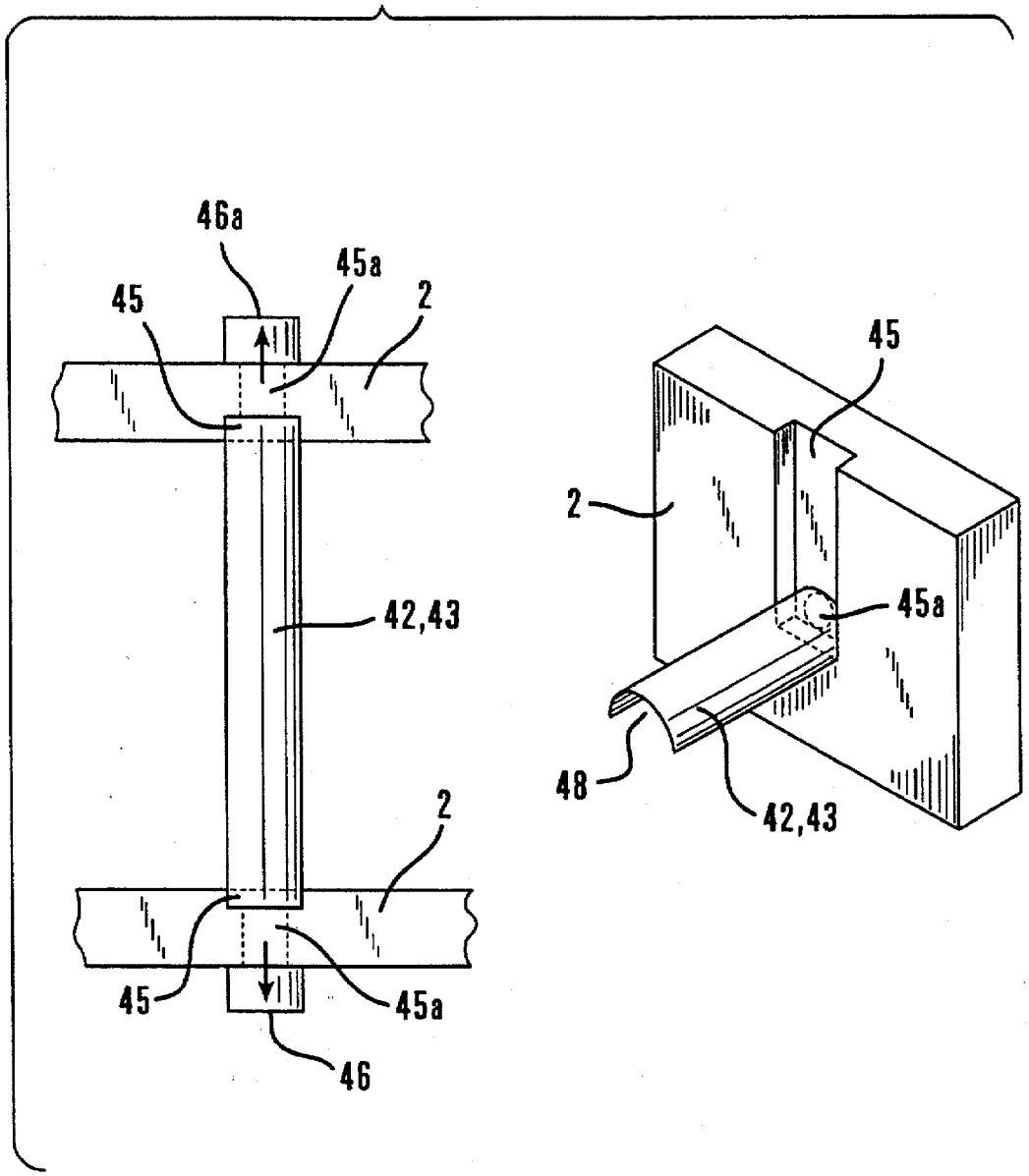
FIG. 8 shows, in the left-hand part of the drawing, a section through two container walls which are opposite one another, with a gas collection assembly located therein and in the right-hand part of the drawing a representation in perspective of a gas collection assembly.

FIG. 8 shows the location of interior components of this type in opposite walls of the shaft. In this case, the shaft walls in the left-hand part are shown partly in cross-section, and are provided in particular with a substantially rectangular recess 45, in which one end of the elements 42 or 43 engages, wherein the elements 42, 43 are longer than the internal distance apart of the set back walls of the oppositely located recesses 45, so that they can be inserted into these recesses. The interior components 42, 43 are then located with the lower rim of their two ends on the lower rim of the recess 45, wherein the walls 2 of the shaft are each provided with a bore 45*a* in this area, which is aligned with or is connected to the gas collection space 48 which is formed by the interior components 42, 43. A aspirating connector or an aspirating hose 46 can connect to the access opening 45*a*.

Figure 9:
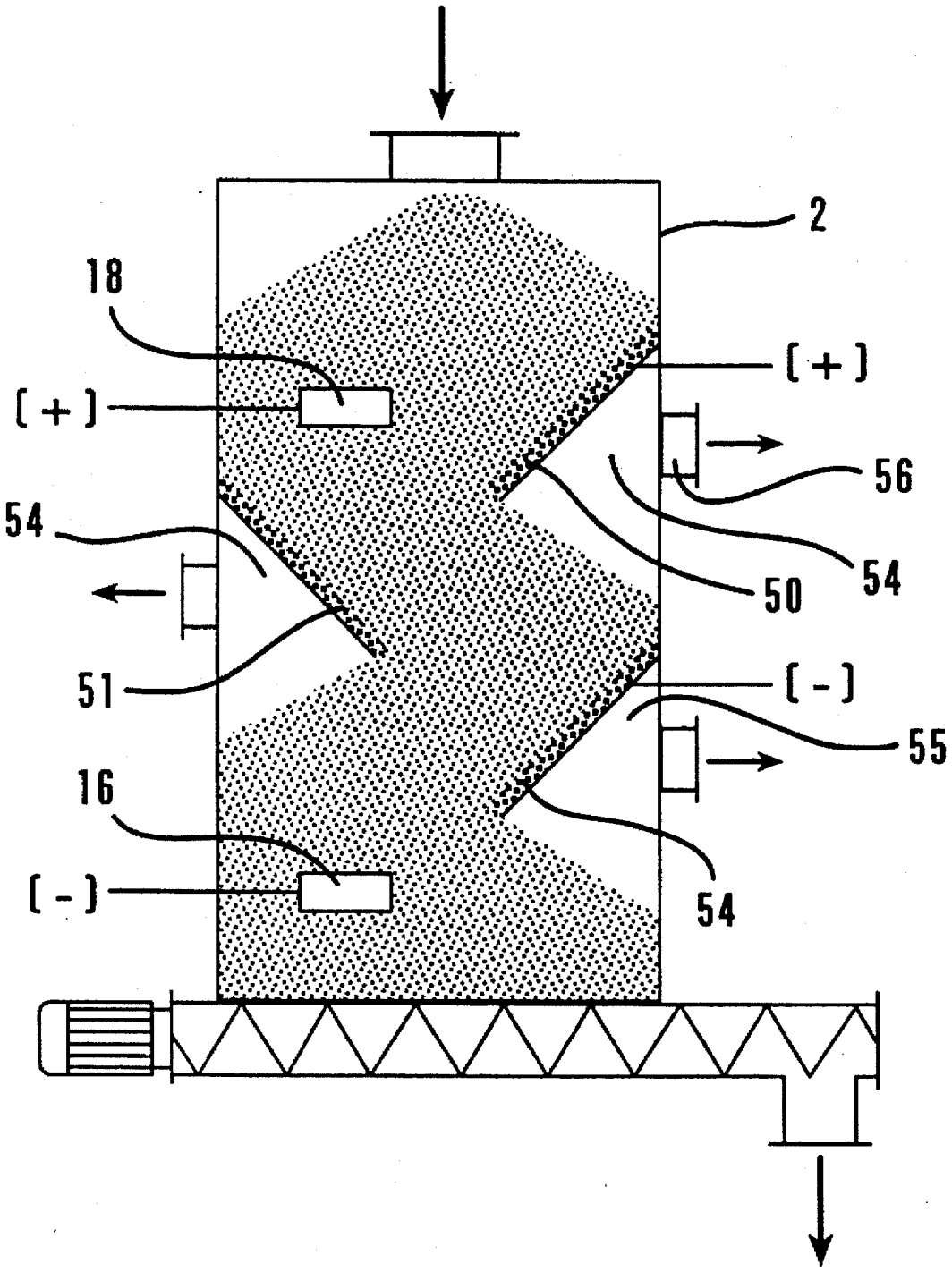
FIG. 9 is a shaft with deflectors protruding from the side walls, which form hollow spaces in conjunction with the shaft wall.

FIG. 9 shows a further variation of a shaft, in which gas collection spaces are provided for the removal of forming gas. In this instance, diagonally downward facing deflectors or guiding elements 50, 51 and 52 are provided on opposite walls 2 of the shaft 1, on the upper side of which the downwardly flowing bulk goods are deflected, so that below each of the deflectors 50, 51, 52 and between each of these and the wall 2 a gas collection space 54 forms. In this case also connectors 56 can again be provided on access openings in the area of the gas collection spaces 54, in order to draw off or aspirate the forming gas. The connectors 56 and access openings as well as the openings 45*a* or the connectors 41 in the embodiment according to FIG. 7 can however also be used for an increased material supply in an advantageous manner. Due to the de-gassing, a change in the specific electrical resistance of the material can also occur, so that possibly the supply of preferably gaseous or liquid, but also powdery or grainy supplementary material which can restore the desired electrical characteristics of the de-gassed bulk goods can prove to be very useful.

The interior components can be made of electric insulating material or be coated with such a material, while there are uses, however, in which metallic, that is electrically conductive, interior components are preferred, which ensure better current distribution in the diagonal direction, or are connected as additional electrodes.

The number and density of the gas collection spaces or interior components to be provided can thus vary along the flow direction of the bulk goods, and should in particular be greater where the de-gassing is particularly strong, so, for example, more likely in the lower area, near to the material delivery. Finally, the arrangement of the gas collection spaces is also a question of the material being processed, the strength of current used and the volatility of the gases bound in the material.

The gas removal aspect will again be described using an example.

EXAMPLE

As already mentioned, the "material dependent electrical resistance, or the change in the resistance thereof as a result of heating", and further "electrical characteristics of the material" play a decisive roll in the optimum functioning of the heating device.

The moisture, which is almost impossible to avoid, of the electrically conductive bulk goods which are provided for heating results in development of vapour during the heating process. The development of vapour is particularly considerable when the bulk goods are brought to temperatures of above 100°.

From the following example, it can be seen that the development of vapour is not negligible:

With a throughput of approximately 30 tph of petrol coke with a water content of only 1%, approximately 30 liters of water per hour is vaporised. This corresponds to a quantity of vapour of approximately 50 $m^3$ per hour at a vaporising temperature of 100° C. As the bulk goods are generally heated to temperatures in the region of 200° C. during flowing through the heating device, the vapour correspondingly takes on a temperature of approximately 200°. As a result of this the resulting amount of vapour is significantly greater.

The vapour occurring does not only change the resistance of the bulk goods during heating, but has a particularly negative effect on the retention of the narrowest possible dwell time, so that consistent temperature of the heated bulk goods at delivery cannot be reliably ensured. The vapour occurring naturally attempts to precipitate onto cold particles of the bulk goods and to condense. This results in the occurrence of a moist layer of bulk goods between the bulk goods cone at the product inlet and the beginning of the warmer zone inside the bulk goods. Inevitably, a certain increase in pressure arises because of the "top sealing" by the moist bulk goods. Geyser-like break throughs of vapour in the direction of product delivery as well as product inlet cannot be avoided. The narrow dwell time needed for uniform heating is thus significantly disrupted.

By means of the gas collection spaces provided according to the invention, preferably in the vertical section of the shaft, in or below which temperatures of approximately 100° C. are reached and thus vapour formation occurs, this vapour can, at least to a great extent, be removed to the outside, which can be aided further by aspiration. In this way the above mentioned condensation on the as yet cold bulk goods particles and the undesired processes resulting therefrom is largely avoided.

We claim:

1. A process for continuously supplying heat to electrically conductive bulk goods during a continuous discharge thereof comprising the steps of:

a) providing an oven chamber to heat said bulk goods comprising an upright shaft having upper and lower ends and including an inlet opening at said upper end and a discharge device at said lower end, b) flowing said bulk goods through said oven chamber and continuously discharging heated bulk goods through said discharge device;

c) providing a positive electrode in said upper end of said shaft such that said positive electrode is passed by said bulk goods in contact therewith upon flow thereof from said inlet opening to said discharge device and providing at least one negative electrode in said lower end of said shaft such that there is a current flow from said positive electrode to said negative electrode through said bulk goods within said shaft; and d) conducting electrical energy into said bulk goods during said continuously discharging thereof in a direction substantially parallel to the direction of said current flow, wherein said current flow extends beyond said negative electrode to said discharge device.

2. A process as claimed in claim 1, including the step of directing said bulk goods downwards in said shaft, said shaft having a substantially constant cross-section such that said heated bulk goods are discharged substantially uniformly from the entire cross-section of said shaft when discharged through said discharge device.

3. Apparatus for continuously supplying heat to electrically conductive bulk goods comprising:

a) an oven chamber comprising an upright shaft having upper and lower ends through which said bulk goods flow, an inlet opening, and a continuous discharge device for said bulk goods, said discharge device being supported in a housing, and b) at least one pair of electrodes through which electrical energy in a bulk goods is conducted during said continuous discharge of said goods, said pair of electrodes comprising a positive electrode located in said inlet opening and a negative electrode provided in a region approximated to said discharge device, wherein said negative electrode and said discharge device are grounded.

4. Apparatus as claimed in claim 3 in which said housing supporting said discharge device is grounded and wherein said discharge device together with said negative electrode functions as a current discharging electrode.

5. Apparatus as claimed in claim 4 in which at least one additional negative electrode is provided at said lower end of said shaft.

6. Apparatus as claimed in claim 5 in which said additional negative electrode is spaced between said discharge device and said positive electrode.

7. Apparatus as claimed in claim 6 in which said additional negative electrode is adjustable with respect to its distance from said discharge device and said positive electrode.

8. Apparatus as claimed in claim 7 in which a grounded guard electrode is provided above said positive electrode in a space which is free of said flow of bulk goods.

9. Apparatus as claimed in claim 8 including a current measuring device for measuring a voltage drop along a grounded connection of said guard electrode.

10. Apparatus as claimed in claim 9 in which said guard electrode is grounded via a resistance above said positive electrode.

11. Apparatus as claimed in claim 3 in which said housing supporting said discharge device is connected to at least one driven transport screw.

12. Apparatus as claimed in claim 3 in which said discharge device comprises a slatted base comprising a plurality of individual slats which are adjustable to form angled openings, and wherein said slatted base is grounded.

13. Apparatus as claimed in claim 3 in which said positive electrode has boundary walls arranged in a funnel shape.

14. Apparatus as claimed in claim 3 in which said positive electrode includes tongues extending from opposite walls of said electrode which are arranged parallel to each other and with their planes aligned in the direction of the flow of said bulk goods.

15. Apparatus as claimed in claim 3 in which said discharge device is provided as a replaceable part which is adapted to be dismantled from said oven chamber.

16. Apparatus as claimed in claim 3 in which said shaft has a substantially constant cross-section.

17. Apparatus as claimed in claim 16 in which said cross section of said shaft includes a first section having a smaller cross-section and second section having a larger cross-section such that said cross-section of said shaft is widened diagonally in a direction of the flow of bulk goods therein to define a widening and wherein hollow spaces are formed by said widening of said shaft.

18. Apparatus as claimed in claim 17 in which said first section of said shaft partially extends into said second section.

19. Apparatus as claimed in claim 18 in which said shaft includes lockable ventilation openings in the area where said first section of said shaft extends into said second section.

20. Apparatus as claimed in claim 19 in which said shaft includes hollow spaces forming interior components in its upper and lower ends.

21. Apparatus as claimed in claim 20 in which said hollow spaces forming interior components extend diagonally through said shaft in a direction vertical to the flow of said bulk goods.

22. Apparatus as claimed in claim 20 in which said hollow spaces forming components form a common hollow space together within said shaft.

23. Apparatus as claimed in claim 20 in which said hollow spaces forming interior components are mounted in recesses on opposite walls of said shaft.

24. Apparatus as claimed in claim 23 in which access openings are provided in said shaft wall which are aligned with said hollow spaces forming interior components.

25. Apparatus as claimed in claim 20 in which said hollow spaces forming interior components are comprised of an insulating material.

26. Apparatus as claimed in claim 20 in which said hollow spaces forming interior components are coated with an insulating material.

27. Apparatus as claimed in claim 20 in which said hollow spaces forming interior components are formed as current conducting electrodes.

28. Apparatus as claimed in claim 17 in which said hollow spaces formed by the widening of said shaft are connected to an aspirating hose.

29. Apparatus as claimed in claim 20 in which said hollow spaces forming interior components are connected to an aspirating hose.

30. Apparatus as claimed in claim 24 in which said access openings are connected to an aspirating hose.

* * * * *